US007210250B2

(12) United States Patent
Gallegos

(10) Patent No.: US 7,210,250 B2
(45) Date of Patent: May 1, 2007

(54) MULTIPIECE FOOTWEAR INSOLE

(76) Inventor: Alvaro Z. Gallegos, 6932 4th St. NW., Albuquerque, NM (US) 87107

( * ) Notice: Subject to any disclaimer, the term of this patent is extended or adjusted under 35 U.S.C. 154(b) by 36 days.

(21) Appl. No.: 11/146,841

(22) Filed: Jun. 7, 2005

(65) Prior Publication Data

US 2006/0277796 A1 Dec. 14, 2006

(51) Int. Cl.
*A43B 13/38* (2006.01)

(52) U.S. Cl. ..... 36/44; 36/71; 36/140; 36/160; 36/31

(58) Field of Classification Search ..... 36/44, 36/71, 140, 31, 43, 141, 145, 155, 159, 160–163
See application file for complete search history.

(56) References Cited

U.S. PATENT DOCUMENTS 1,148,584 A * 8/1915 Gerrish ..... 156/258
1,575,813 A * 3/1926 Burke et al. ..... 12/145
4,633,877 A * 1/1987 Pendergast ..... 36/140
4,841,648 A * 6/1989 Shaffer et al. ..... 36/43
5,359,791 A 11/1994 Prahl
5,768,803 A 6/1998 Levy
6,792,699 B2 * 9/2004 Long et al. ..... 36/88
2004/0103561 A1 6/2004 Campbell
2004/0194348 A1 10/2004 Campbell
2004/0194352 A1 10/2004 Campbell

FOREIGN PATENT DOCUMENTS

WO WO92/00714 * 1/1992

* cited by examiner

*Primary Examiner*—Ted Kavanaugh
(74) *Attorney, Agent, or Firm*—Ray R. Regan

(57) ABSTRACT

The invention relates to an insole for use in footwear, and is comprised of a plurality of sections that are removably or securably attachable to a bottom layer. The sections can be made of different materials to provide different types of support, e.g. rigid or shock absorbing. The sections may also have different surface characteristics, which for example grip a portion of the foot or are slick to enable the toes to move. The insole can be used to at least partially abate and/or prevent foot and related ailments commonly suffered by diabetics and others with pathologic or painful foot conditions. A kit for making an insole is also contemplated wherein a variety of insole sections are provided that have different cushioning or support features and/or different surface characteristics. The user can choose the preferred insole sections and assemble the sections onto the bottom layer, thereby constructing a customized insole.

20 Claims, 10 Drawing Sheets

MULTIPIECE FOOTWEAR INSOLE

TECHNICAL FIELD

The present invention relates generally to an insole device for use in shoes and other footwear with a plurality of sections that can be made of different materials and/or have different surface characteristics. The insole is especially useful in partially abating and/or preventing foot and related ailments commonly suffered by diabetics, and others with pathologic or painful foot conditions.

BACKGROUND INFORMATION

Diabetes mellitus is a chronic disease that affects the lives of millions of people in the United States and around the World. Many diabetics will develop a serious foot conditions at some time in their lives, which in some cases require toe amputations or even amputations of the entire foot. High blood sugar levels also affect the body's immune system and delays wound healing.

Neuropathy is an impairment that affects about half of those with diabetes, and causes loss of feeling in feet, which increases the risk of undetected injury. Diabetics suffering from neuropathy can unknowingly develop minor cuts or scrapes, blisters, or pressure sores due to the feeling insensitivity. If such minor injuries are left untreated or fail to heal, complications may lead to ulceration, infection, and gangrene. In fact, diabetic foot complications are the most common cause of non-traumatic lower extremity amputations in the United States. The risk of lower extremity amputation has been estimated to be about 15 to 46 times higher in diabetics than in non-diabetics. Importantly, the majority of diabetic foot complications begin with the formation of skin ulcers on the bottom of the foot.

Specially designed footwear for diabetics as well as other orthopedic devices can reduce the risk of many foot complications, such as the formation of calluses, foot ulcers, poor circulation, decreased resistance to infection, foot deformities, and neuropathy, that are especially problematic for diabetics.

Custom orthopedic footwear for diabetics often has a relatively rigid, resilient base comprising a heel portion and an arch portion, which are contoured to fit the plantar or bottom surface of the foot. Unfortunately, most customized prescription orthopedic footwear and/or footwear devices for diabetics require the preparation of molds for the feet and subsequent manufacturing of the footwear and/or devices with a significant delay of many weeks between the measuring of feet for an orthopedic shoe or device and the arrival of the new customized device, such as insoles as well as footwear. The custom insoles are generally created from hard plastics by making a mold that is based upon detailed foot measurements, and is then modified as needed to provide prescribed corrections by a podiatrist. Custom orthopedic footwear may also be unattractive and the footwear will not be as versatile as insoles that can be placed within ordinary shoes and other footwear.

Conventional footwear inserts or soles that may consist of materials such as rigid plastic and/or elastomeric foam with an impact cushioning foam layer or space filler, usually provide insufficient foot protection and/or do not address the different needs of the various areas of the foot, which can be unique to wearers. The insoles often do not provide enough protection or support for proper biomechanical functions of the foot, particularly in the rear foot area, and in the arch areas of the foot. Also, conventional insoles typically do not hold a wearer's heel in place and also provide arch support, as well as allow certain movement of the foot such as in the toe area that allows the toes to slide and move. Thus, such conventional inserts and soles are often ineffective in preventing or alleviating foot conditions experienced by diabetics and other persons with foot problems.

Special footwear and/or footwear components and devices are considered one of the best ways to prevent the aforementioned problems of diabetics and others. It is also believed that many foot and toe complications of non-diabetics could be prevented through the use of the insoles of this invention. In an embodiment, the insole has sections that are for a variety of foot shapes and that can be customized for a variety of wearers and wear requirements. Also if desired, one or more of the sections can have different cushioning and/or surface characteristics.

DRAWINGS

FIGS. 7A and 7B show an assortment of insole sections for a left foot insole;

FIG. 7C shows the top view of an embodiment of a bottom insole layer for a left foot insole;

FIG. 7D shows the top view of an embodiment of a bottom insole layer for a right foot insole;

FIGS. 7E and 7F show an assortment of insole sections for a right foot insole; and FIG. 7G shows an embodiment of the underside of the insole sections for a left foot.

SPECIFICATION

In this invention, the insole is comprised of multiple pieces or sections that can be made from a variety of materials and/or sections can have different surface characteristics. The insole of this invention is much more versatile and can be constructed in a fraction of the time in comparison to conventional custom or special-fit insoles. Further, depending upon needs and changes in a wearer's foot, certain sections can be switched with other counterpart sections that can be made from a spectrum of different materials having different hardnesses and/or different surfaces. For example, the insole sections can be comprised of cushioning materials or rigid materials to lend support, rigid materials, and those in between. The surface type can also vary based upon type and location of the sections. For example certain surfaces can be slick or smooth have a low co-efficient of friction, such as those that would enable the toes to move and slide, to surface types that are gripping to prevent sliding of portions of the foot, such as the heel. The ability to slide and move the toes of the foot may also enhance circulation in the foot.

Figure 1:
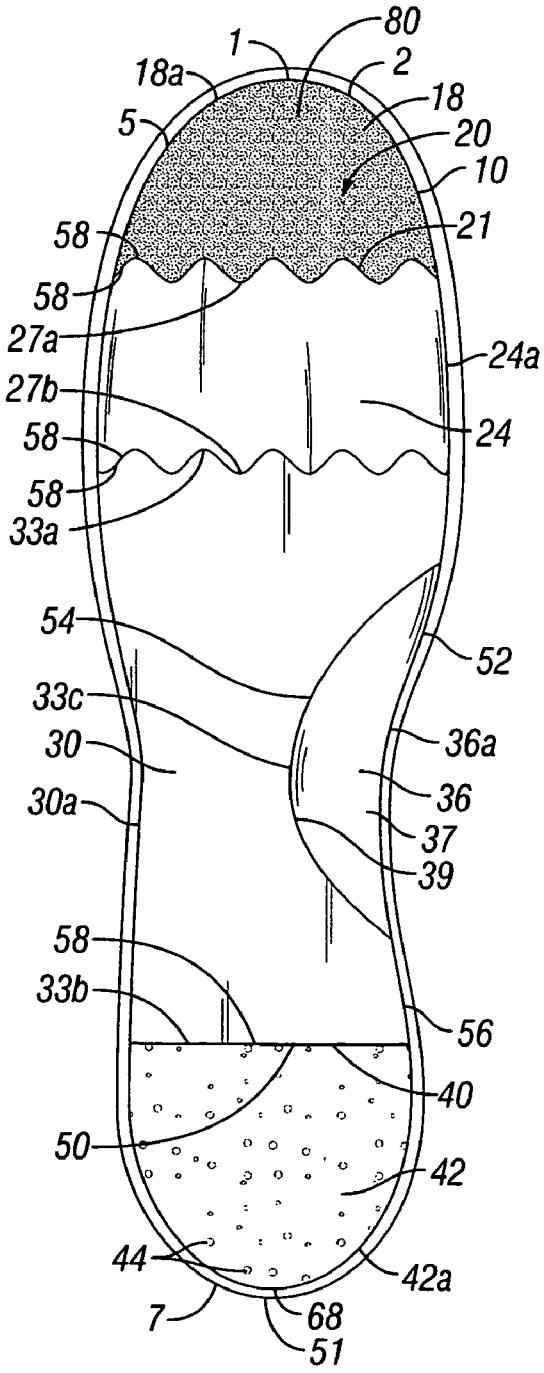
FIG. 1 is a top side view of an insole of this invention for the left foot in an assembled state.
Figure 1A:
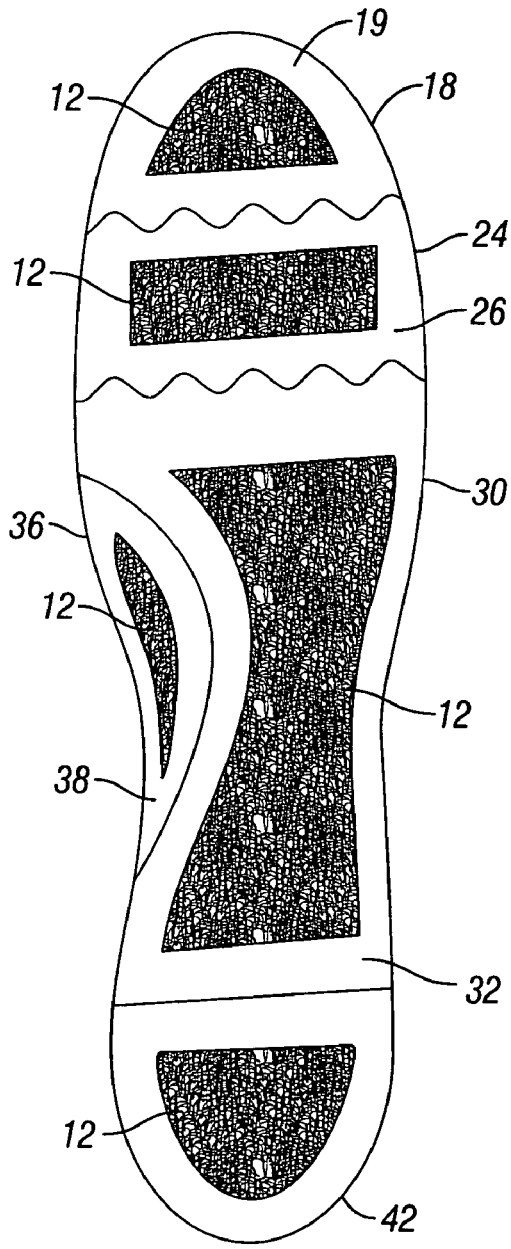
FIG. 1A is a view of an insole of FIG. 1 showing the undersides of the sections.
Figure 2:
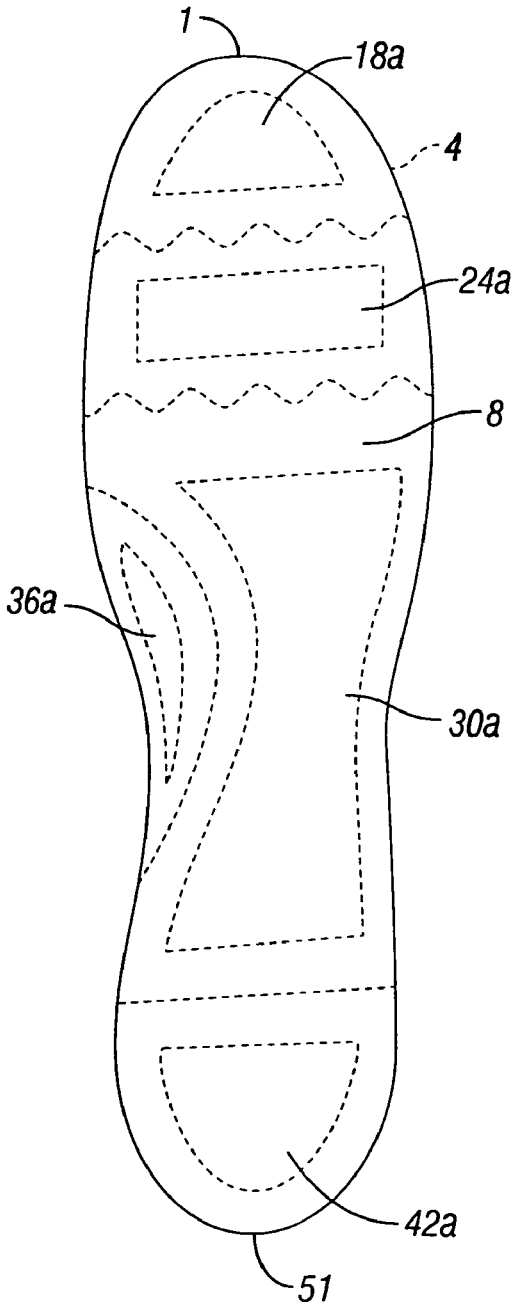
FIG. 2 is a bottom view of the bottom layer of the insole of FIG. 1.
Figure 2A:
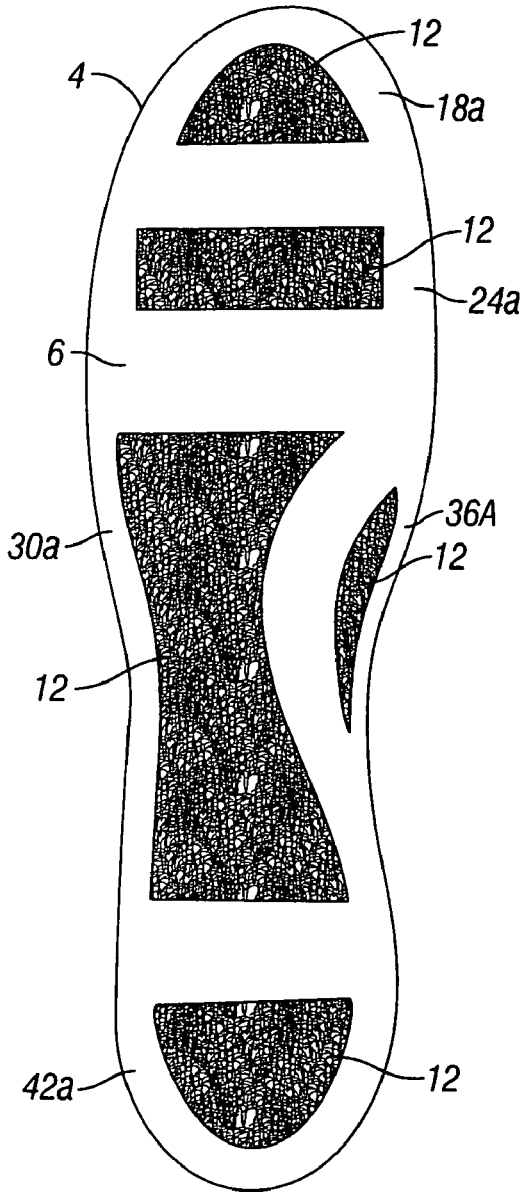
FIG. 2A shows the top side of the bottom layer of FIG. 2.

FIG. 1 shows a top side view 5 of an insole 2 of this invention for the left foot with the insole sections in their respective positions and in an assembled state, with at least one medial edge shaped to that fits together with a medial edge of an adjacent section, and FIG. 1A shows the undersides 19, 26, 32, 38, 41, respectively, of the toe sections 18, metatarsal section 24, base section 30, arch section 36, and heel section 42 of FIG. 1. FIG. 2 shows the bottom view 8 of the bottom layer 4 of the insole of FIG. 1, and FIG. 2A shows the top side 6 of the bottom layer 4 of FIG. 2, and the attachment members on the top side of the bottom layer. As shown in those figures plus FIGS. 3, 3A, 4, 4A, and 4B which show a side view, the insole has a bottom layer 4 having a top side 6 and a bottom side 8, and is comprised of a plurality of sections 10.

Beginning at the anterior-most end 1 of the insole 2 of FIG. 1 is a toe section 18, having a top surface 20. Moving toward the posterior end of the insole, the toe section has a medial edge 21 that in an embodiment is irregular and is waved. The pattern or design of the respective edge of the adjacent piece, here the medial edge 21 of the toe piece, is of a shape complimentary to the medial edge 27*a* of the metatarsal section 24, which has a top side 25. In the embodiment of FIG. 1, the arch piece 36 is shaped so as to extend into the metatarsal area of the insole. Moving further posteriorly is another medial edge 27*b* of the metatarsal section that interfaces with the medial edge 33*a* of the base section 30, which has a top side 31. The arch section 36 is adjacent to the base section and has a curved 54 medial edge 39 adjacent to medial edge 33*a* of the base section 30. The top side of the arch section 37 is shown. Next, the medial edge 33*b* of the base section 30 is adjacent to the medial edge 40 of the heel section 42. Here, the top side 43 of the heel section has a plurality of protrusions 44 that are raised areas that serve to grip the heel of a wearer's foot. FIG. 1 shows a left insole for a left foot. The right insole for the right foot would be a mirror image of the left foot insole of FIG. 1.

The sections are usually of different sizes and of different shapes and can vary in thicknesses, depths, and/or elevations. Each insole section can be comprised of one or more of material types and can be a variety of thicknesses from a few millimeters to a few centimeters. The insole sections can be securably attached to a bottom layer, removably attachable to a bottom layer, or alternatively, integral with the bottom layer. The insole can be designed so that any of the sections can be integral with the bottom layer. FIGS. 7A–7G also show a kit for making the insole.

The insole sections can be comprised of one or more layers of material. In an embodiment, one or more of the insole sections have semi-rigid or rigid support members underneath or molded within the insole section. Also if desired, a section can be constructed from one type of material, and have a covering layer on the top surface comprised of another material. A variety of materials can be used as a top covering layer for the insole sections. If a top layer is used, it can have a variety of thicknesses of material, from a few millimeters to less than about 1 to 1.5 centimeters. The top layer can have a variety of surface characteristics and be made of synthetic and/or natural materials such as silk, fur, felt, satin, leather, polyester, cloth or sheeting, as well as foam, rubber, plastic materials, and any other materials known to one skilled in the art that are suitable for insoles and insole coverings.

The assembled insole 2 is generally foot-shaped and/or has the approximate shape of the inside perimeter of the bed 7 of conventional footwear or shoes. See e.g. FIGS. 1, 2, 4, 4A, 4B, and 6. The insole 2 is formed of a plurality of sections that are integral with the insole or that are removably attachable or securably attachable to at least a portion of the top side 6 of the bottom layer of the insole. In an embodiment, the sections are comprised essentially of a longitudinal arch section 36, a heel section 42, a toe section 18, a metatarsal section 24, a base section 30, or any combination thereof. Of course one or more of these sections can be combined or can extend into other areas of the insole. The various insole sections fit together similar to puzzle pieces to form an insole, and in an embodiment, the sections have medial edges that fit together with the medial edge of at least one other section in a puzzle-like manner.

Figure 5:
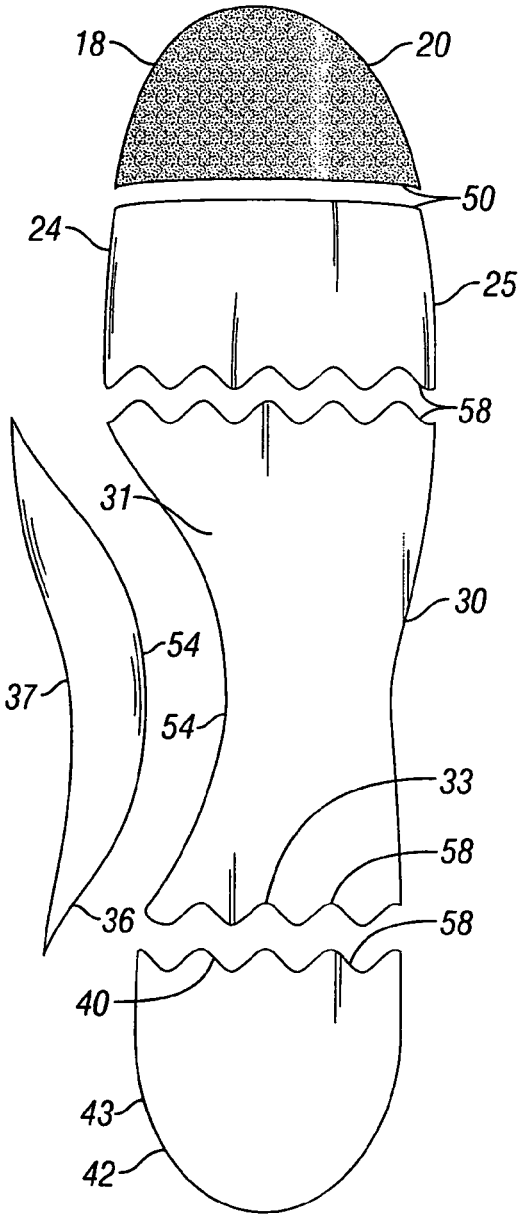
FIG. 5 is a top view of insole sections for a right foot in a disassembled state like that of FIGS. 3, 3A, and 4.

The edges between the pieces can be straight 50 as those between the toe piece of FIG. 5 and the heel in FIG. 1, or curved as in the median edge 39 of the arch piece 36 and medial edge 33*c* of the base piece 30 in FIGS. 1, 5. However, for comfort, the edges of the insole in the weight bearing areas are preferably irregular so that the wearer does not feel a seam or separation between the sections. For example the edges can be wave shaped or shaped like a repeating "w", "u", or "v", or any combination of the foregoing. As shown in FIG. 1, for example, the toe section 18 adjacent to the metatarsal section 24 has edges that are wavy 58 and the edge 27 of the metatarsal piece 24 adjacent to the toe piece is irregular in a corresponding wave-shaped edge 58. As shown in FIG. 5, the medial edge 33 of the base piece 30 adjacent to the heel piece 42 is wavy 58 and the medial edge 40 of the heel piece 42 adjacent to the base piece 30 is irregular and wave-like 58 in a corresponding shape. As defined herein, a medial edge is the edge of the insole sections that is adjacent to at least one other section and interfaces with another insole section. Also as shown in FIG. 1, some edges between some pieces are straight, while the edges between other pieces are irregular.

If the sections are removably attachable, there are various ways to attach the sections to the insole or a bottom layer of the insole, such by using attachment members such as adhesives, glue, magnets, a wedge and aperture connection, studs, snaps, hook and loop fasteners such as Velcro-type hook and loop fasteners, hook and eye fasteners, and other means or materials known to one skilled in the art for removably attaching materials to each other. The attachment members are located on the top side of the bottom layer 6 and on the underside 11 of such sections 10. In the insole embodiments of FIGS. 1, 4, 5A, 6A,7C, 7D, and 7G the attachment members comprise hook components 14 and counterpart loop components 16 like those found in Velcro and Velcro type materials. The Velcro-type attachment members are secured to the sections and bottom layer by adhesives and/or stitching. The hook components can be attached to the top side of the bottom layer and the loop components can be attached to the underside of the removable sections or similarly, the hook components can be attached to the underside of the removable sections and the loop components can be attached to the top side of the bottom layer. In any case regardless of the position of the attachment members on the underside of the sections and the bottom layer, when the hook and loop components are joined together, they form a holding assembly 17. Also, Velcro-compatible continuous-loop fabrics can be used for the loop counterparts such as nylon which is available under the trade designation "Tricot."

Figure 7A:
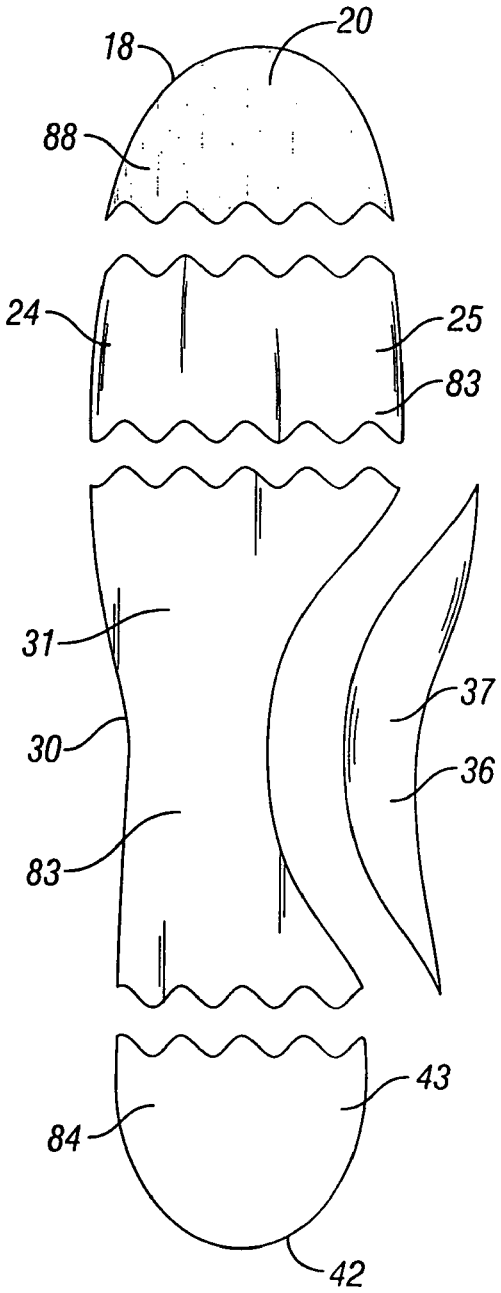
FIGS. 7A–7G show a kit for making a right sided and left sided insole that is comprised of toe sections, metatarsal sections, base sections, arch sections, heel sections, and bottom insole layers.
Figure 7B:
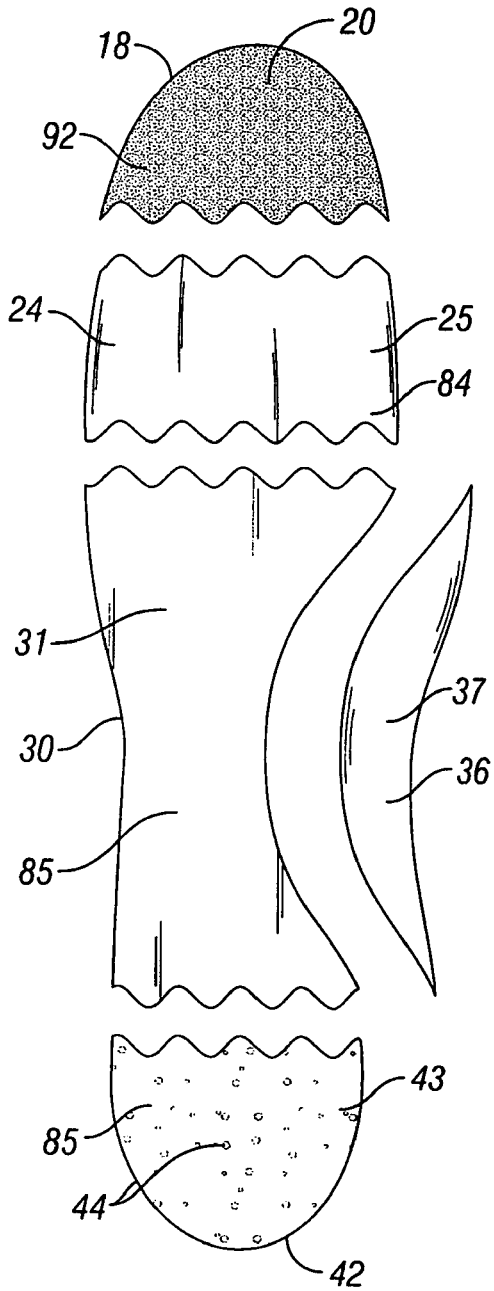
Figure 7C:
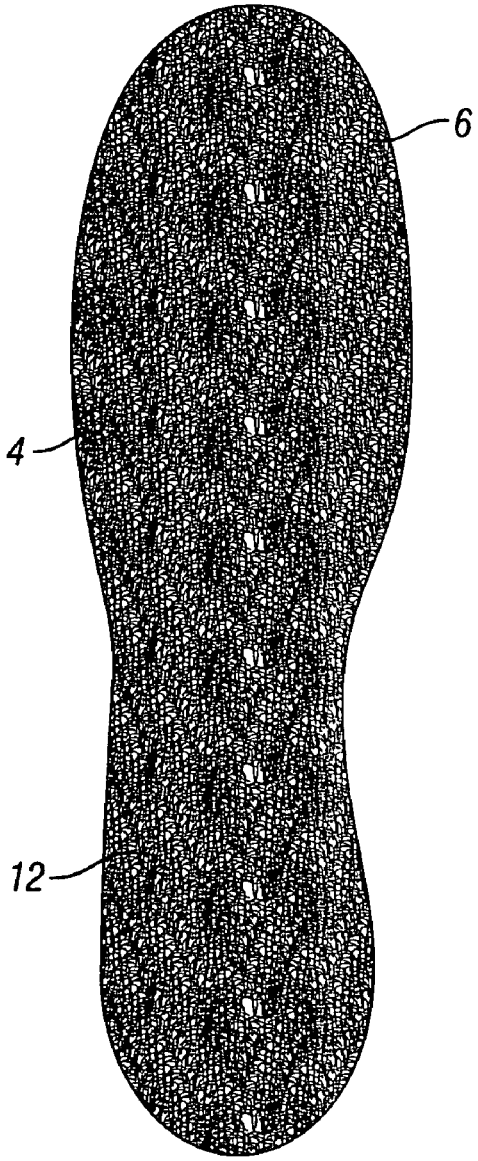
Figure 7D:
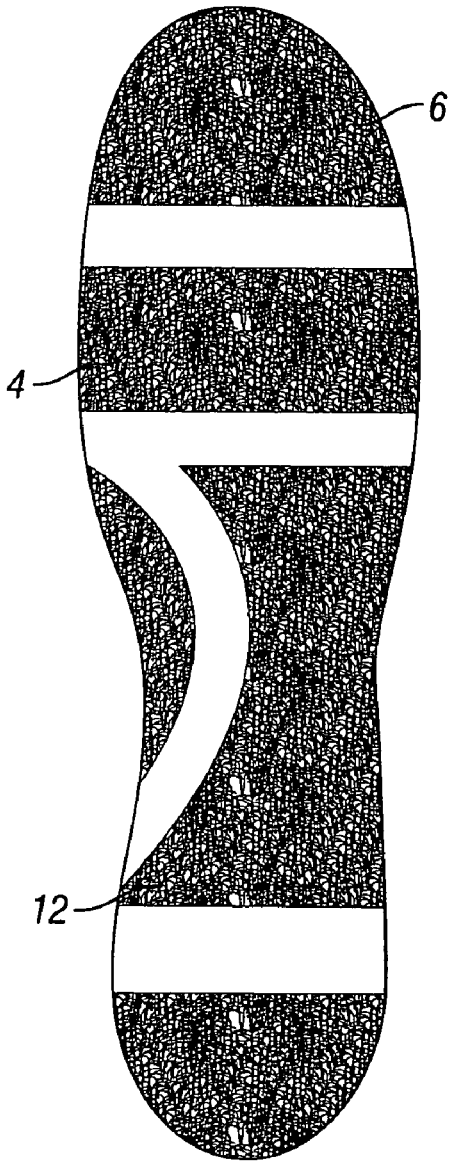
Figure 7E:
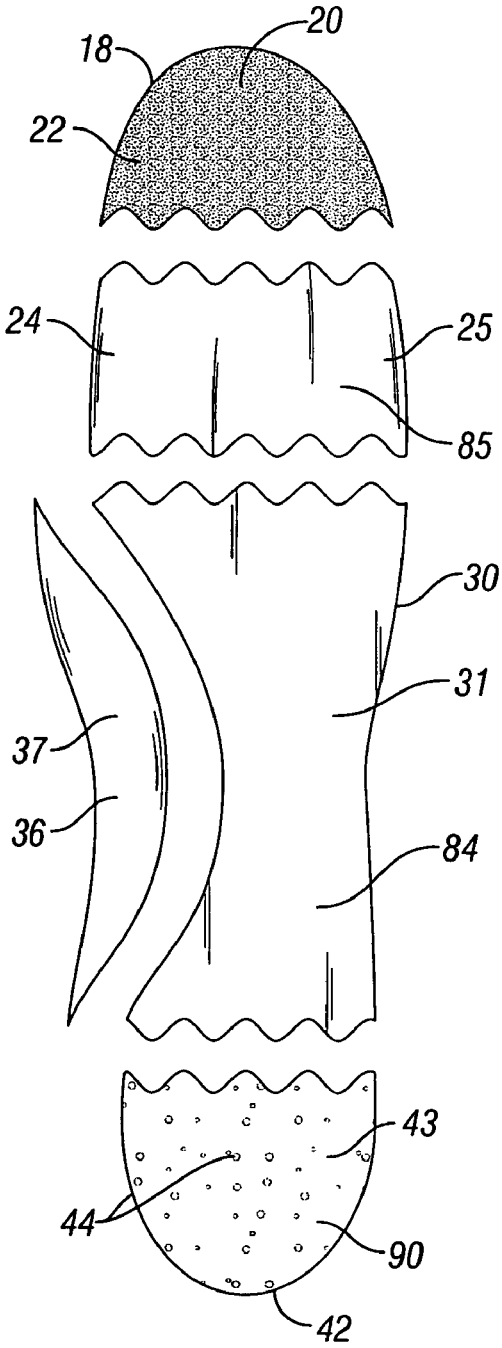
Figure 7F:
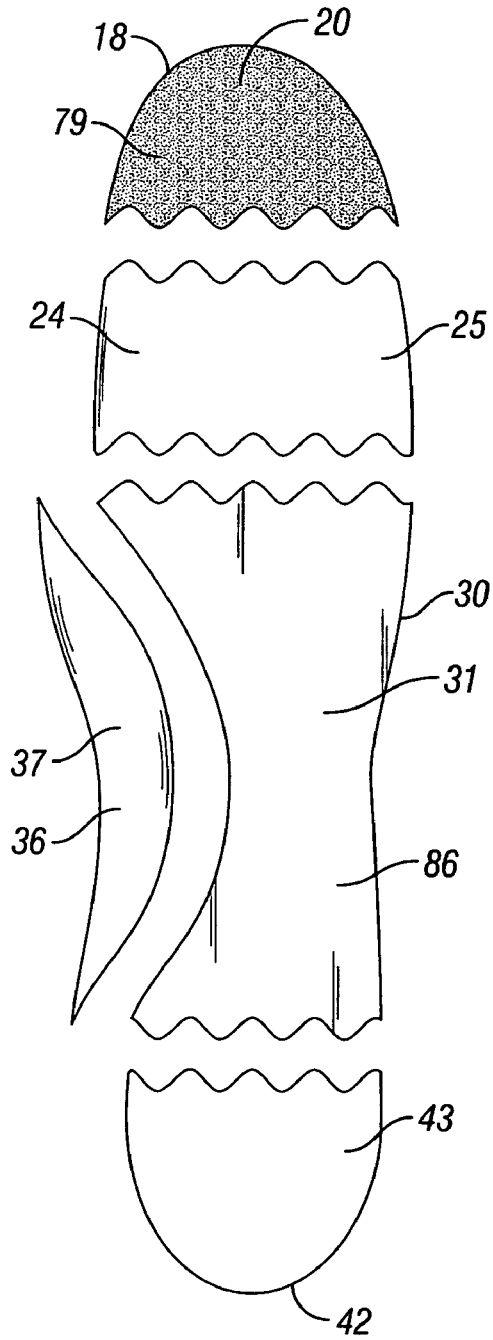
Figure 7G:
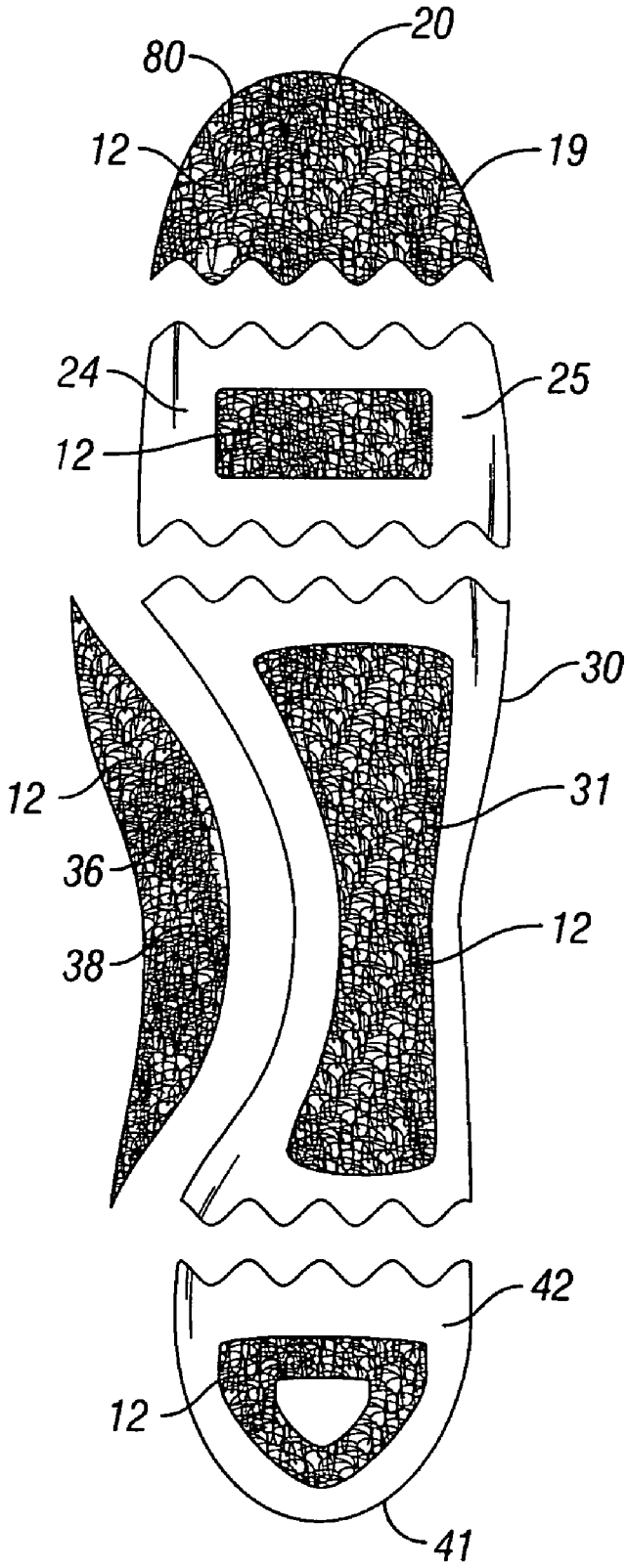

The hook and loop fasteners can cover the entire surface of the section and bottom layer, see e.g. FIG. 7G or instead a portion thereof, see e.g. FIGS. 2, 7G. Alternatively, if the sections are securably attached to the bottom layer, they can be integral or part of the bottom layer such as through molding, or attached by adhesives, heat bonding glue, and/or stitching, or other ways known to one skilled in the art.

The bottom layer 4 of the insole 2 is a support layer and/or is a cushioning layer and can be made from a variety of materials, especially foam materials which have elastic or rebounding properties, such as those consisting essentially of silicon, polyester, neoprene, natural rubber foams, synthetic rubber foams, polyurethane, polyether and polyester foams, neoprene, vinyl nitrile, styrene-butadiene rubber (SBR), polyethylene (PE), ethyl vinyl acetate (EVA), ethylene propylene terpolymer (EPT), EPT/PE/butyl rubber, neoprene/EPT/SBR, epichlorohydrin (ECH), and nitrile (NBR) or any combination thereof, as well as other cushioning materials known or used by one skilled in the art. Of course the bottom layer of the insole may also be comprised of natural materials, such as leather, cotton, felt, linen, and other such materials known to one skilled in the art. The bottom layer should also be durable so that it does not tear apart when the sections are removed and replaced during use. Also, only a portion of the bottom layer can be made of a support type material with the remainder being cushioning material. The support materials comprise materials that provide at least some support can be shaped and that are not completely rigid, such as leather and metal, but can also be rigid or semi-rigid, such as plastic, rubber and other materials known to one skilled in the art for such purposes, are also suitable. The bottom layer can be of a variety of thicknesses from a few millimeters to a centimeter or less.

If different material characteristics are desired, one or more of the sections will be made of different materials. The insole sections can be comprised of one or more synthetic or natural materials selected from plastic, metal, metal alloys, gels, and those consisting essentially of silicon, polyester, neoprene, natural rubber foams, synthetic rubber foams, polyurethane, polyether and polyester foams, neoprene, vinyl nitrile, styrene-butadiene rubber (SBR), polyethylene (PE), ethyl vinyl acetate (EVA), ethylene propylene terpolymer (EPT), EPT/PE/butyl rubber, neoprene/EPT/SBR, epichlorohydrin (ECH), and nitrile (NBR), and various types of polymer foams, leather, cotton, felt, linen, or any combination of one or more of the foregoing, or other materials known or used by one skilled in the art. In an embodiment, the foam of the sections also molds to the contours of the foot when worn, to reduce the pressure points and for enhanced comfort. If desired, the insole section can contain rigid or semi-rigid materials that are enclosed or encapsulated in other materials give support to the insole sections.

The materials for each section are chosen based upon the desired characteristics for each section. For example, if the insole section should have elastic or rebounding properties, it is typically comprised of materials that have cushioning abilities that rebound. In contrast if the insole section should support a certain area of the foot, such as the arch area, then the material would be chosen from a type of material known by one skilled in the art that can be shaped and used to support an area of a foot, for example, such as metal, leather, and/or plastic, with or without a top layer of other type of material. As a further example, if the insole section should allow a portion of the foot to easily move, such as the toe area, the ideal material will have a low co-efficient of friction such as fur or silk 80 as shown in FIG. 1, or nylon, polyester, metals, metal alloys and other such materials known to one skilled in the art. If the insole section should have gripping properties such as in the heel section, the material would be chosen from a type of material known by one skilled in the art that is used to grip an area of a foot such as rubber or foam, with or without a contoured surface. Of course any other materials that are known or used by one skilled in the art for making insoles can be used for any of the sections.

Also, certain sections have a top covering layer 3 that is made of different materials to give the top portion of the sections different characteristics. See e.g. FIGS. 3, 3A. A variety of materials can be used for a top layer 3 such as silk, nylon, polyester, leather, cotton, felt, linen, furs, furs that are partially shared or short fur, such as moleskin, plastic, metal, metal alloys, gels, and those consisting essentially of silicon, polyester, neoprene, natural rubber foams, synthetic rubber foams, polyurethane, polyether and polyester foams, neoprene, vinyl nitrile, styrene-butadiene rubber (SBR), polyethylene (PE), ethyl vinyl acetate (EVA), ethylene propylene terpolymer (EPT), EPT/PE/butyl rubber, neoprene/EPT/SBR, epichlorohydrin (ECH), and nitrile (NBR), and various types of polymer foams, and other such materials known to one skilled in the art. For example, the toe section 18 may have a top layer that is slick like silk, or that is soft and/or has a low coefficient of friction like fur. If a top layer is present, it can be connected to the topside of the respective section by any means known by one skilled in the art such as attachment members, comprising hook and loop fasteners, snaps, magnets, stitching, glue, adhesives, or any combination thereof.

Beginning at the posterior-most end 51 of the insole of FIGS. 1, 3, 3A, 4, 4A, 5, 5A, 6, 6A, 7A–7G, there is a heel section 42. The heel section 42 corresponds to the heel area 42*b* of the foot and is placed in the heel area 42*a* of the bottom layer of the insole. See FIGS. 3, 3A, and 4. The heel section can be made of a variety of materials previously listed or any combination of one or more of the foregoing, as well as others known to one skilled in the art. In an embodiment, materials that have gripping and/or cushioning properties are preferred. Also, portions of the topside of the section may be raised such as the heel section that have rounded protrusions 44, but may be of like material like that of the section. For example, the heel section 42 can made of rubber or polymer foam based materials that have a plurality of protrusions 44 that are essentially and have a gripping and/or massaging action on the wearer's heel 42*b*. See FIGS. 1, 3, 3A, 4, 4A and 4B. The protrusions can be of various heights from about 1/16 inch to about 1/4 inch. The heel section may also have a slight concave shape 66 so as to cup the heel of the wearer's foot. See FIG. 4B. The protruding members should also be rounded or flat at the top end so they do not puncture or damage the heel of a wearer's foot, and can be evenly spaced or instead irregularly spaced. The heel section 42 can be removably or securably attached to the bottom layer, or can be an integral part of the bottom layer and in an embodiment is molded neoprene.

Next, moving toward the anterior end 1 of the insole there is a longitudinal arch section 36 that corresponds to the longitudinal arch portion of a foot 36*b* and is placed in the arch area 36*a* of the bottom layer of the insole. See FIG. 4. The longitudinal arch section can be of various lengths and widths and is usually adjacent to the base section 30 area, see e.g. FIG. 5, or may be longer and extend into the heel 42 and metatarsal sections 24 as in FIG. 1.

The arch section 36 can be removably or securably attached to the bottom layer, or can be an integral part of the bottom layer. In an embodiment, the arch section is shaped similarly to a wearer's foot arch, and serves to support the arch. The arch section can be comprised of a variety of materials that provide at least some support and can be shaped, such as plastic and rubber and other materials known to one skilled in the art for such purposes.

Moving towards the anterior side or front of the insole is a metatarsal section 24, which corresponds to the metatarsal region of a foot 24*b* and is placed in the metatarsal area 24*a* of the bottom layer of the insole. See FIGS. 3, 3A, 4. As shown in the side view of FIGS. 3, 3A, 4, 4A, and 4B the metatarsal piece 24 is shaped with a concave recess 67 that accommodates the first metatarsal joint of a foot. It is made of materials that provide at least some support can be shaped and that are not completely rigid, such as leather. Of course, synthetic materials that can be rigid or semi-rigid, such as plastic and rubber and other materials known to one skilled in the art for such purposes are also suitable. In an embodiment, the surface of the metatarsal section is preferably substantially smooth, but does not have to be smooth. The metatarsal section 24 corresponds to the metatarsal area of the foot.

The most anterior part 1 of the insole is the toe section 18 that corresponds to the toe region 18*b* of a foot, and is placed in the toe area 18*a* of the bottom layer of the insole. See e.g. FIGS. 4A–4B. The toe section 18 can be removably or securably attached to the bottom layer, or can be an integral part of the bottom layer. The toe section can be comprised from a variety of materials previously listed or any combination of one or more of the foregoing, as well as others known to one skilled in the art. Typically, the toe section is covered with a top layer, but does not require that the section be covered by another type of material. In an embodiment, the top surface of the toe section allows the toes to easily move, and materials that are slick, such as silk, nylon, polyester, and furs that are partially shared or short fur, such as moleskin, which have a low coefficient of friction and allow the toes to move or slide, are preferable.

The base section corresponds to the area of the insole not covered by the other sections. In FIGS. 1 and 5, the base section 30 is the area adjacent to the longitudinal arch section. The base section is one of the largest, if not the largest section should be made of durable material such as leather, but can also be a variety of materials previously listed or any combination of one or more of the foregoing, as well as others known to one skilled in the art. The base section 30 corresponds to the base section of the foot and is placed in the base area 30*a* of the bottom layer of the insole. See e.g. FIGS. 3, 3A, and 4. In an embodiment, the base section is comprised of materials that have gripping and/or cushioning properties.

FIG. 2 shows the bottom side 8 of the bottom layer 4 of FIG. 1. The bottom side 8 of the bottom layer can be smooth or textured. It can also have at least one attachment member, such as those previously described with corresponding attachment members on the bed of the shoe to keep the insole in place. Of course if desired, an assembled insole can be permanently anchored to the inside of the footwear by adhesives, glue, stitching, or other means known by one skilled in the art.

Figure 3:
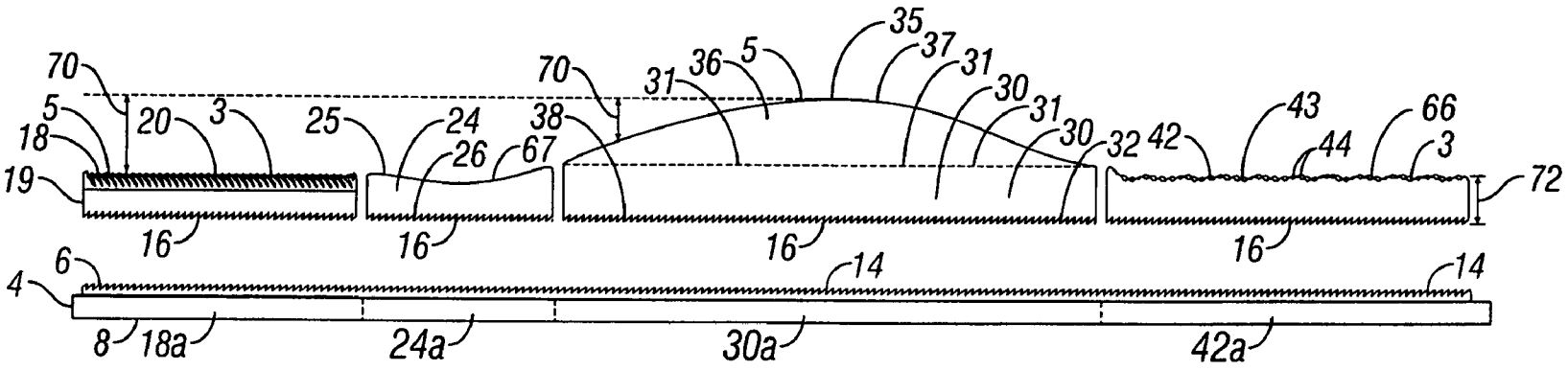
FIG. 3 is a right side view of an insole for the left foot, with the sections of the insole in a disassembled state, but in their respective positions.
Figure 3A:
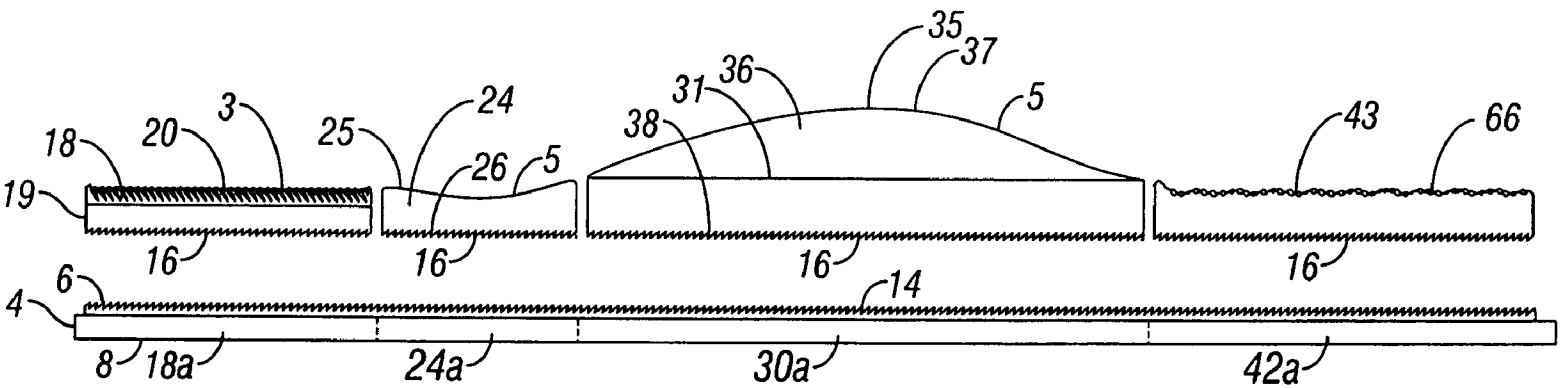
FIG. 3A is a left side view of the insole of FIG. 3, with the sections of the insole in their respective positions, but in an unassembled state.
Figure 4:
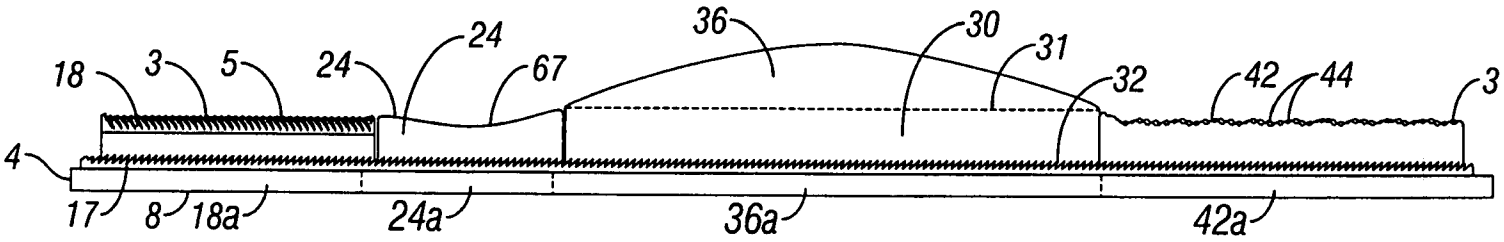
FIG. 4 is a right side view of the insole of FIGS. 3–3A in an assembled state.
Figure 4B:
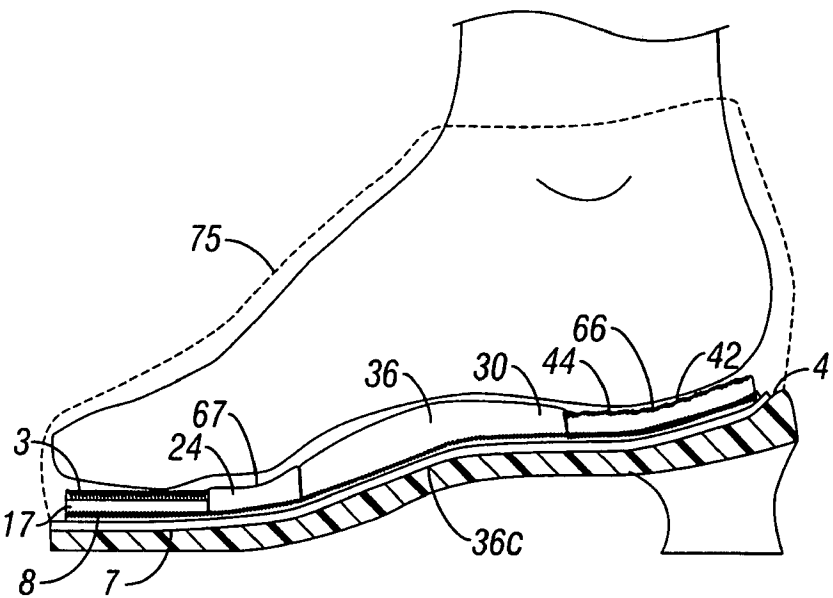
FIG. 4B is a right side view of the insole of FIG. 4 in use in footwear.
Figure 4A:
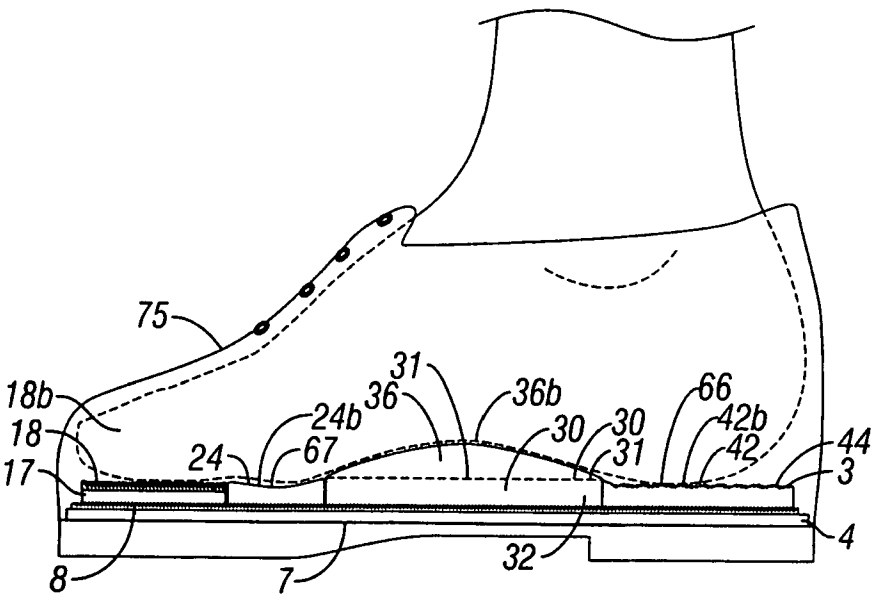
FIG. 4A is a left side view of the of the insole of FIG. 4 in use in footwear.

FIG. 3 shows a right side view of an insole for the left foot and FIG. 3A shows a left side view of the insole of FIG. 3, with the sections of the insole in their respective positions, but in an unassembled state. FIG. 3 is a right side view of an insole for the left foot in an unassembled state, and FIG. 3A, is the left side view of the insole of FIG. 3. The left side of the insole of FIG. 3A has a similar appearance of that of the right side view of FIG. 4A with the exception that the bottom layer appears around the arch section of the insole as dotted lines in FIGS. 3 and 4. FIGS. 4A and 4B show a left side view and right side view of the assembled insole in use in footwear, with the insole resting on the bed 7 of the footwear 75.

FIGS. 3, 3A show the sections of the insole over a bottom layer 4 having a top side 6 and a bottom side 8. In an embodiment, the top side 6 of the bottom layer 4 is covered with attachment members that are complimentary to those on the undersides of the sections. Here, the hook and loop fasteners are present on the bottom layer and on the underside of the sections. The insole also has a toe section 18 with a top surface 20 that in this embodiment is moleskin or another type of short or sheared fur 22. Next to the toe section 18 is a metatarsal section 24 with a concave depression 67 to accommodate the metatarsal joint of the foot. The metatarsal section 24 has a top surface 25 and a bottom surface 26, wherein the bottom surface 26 is attached to the loop fasteners in the same manner as that described for the toe section. Next, adjacent to the metatarsal section is an arch section 36 with a raised arch area 35 that has a top surface 37 and a bottom surface 38, with attachment members 16 attached thereto. Next, the heel section 42 has a top side 43. The top side may have a plurality of protrusions 44 that serve to grip the heel, with a concave shape 66 that cradles the heel of a wearer. In an embodiment, there is also a base section 30 that has attachment members on the underside 32. FIG. 4 shows the toe section 18, metatarsal section 24, arch section 36, and heel section 42 in its assembled state with the attachment members joined to one another, thereby forming a holding assembly 17.

Figure 5A:
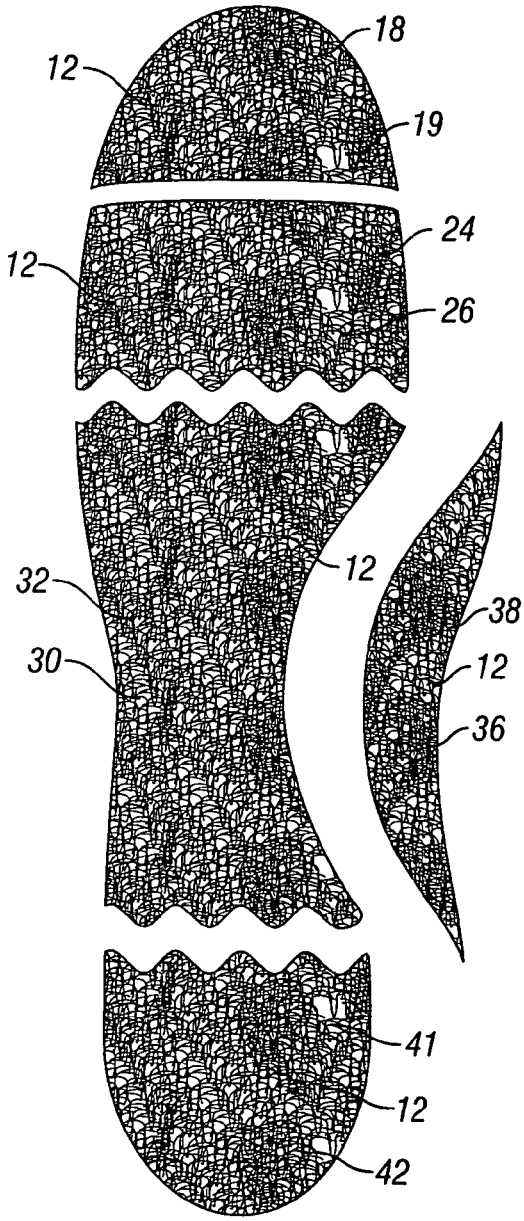
FIG. 5A is an underside view of the sections of FIG. 5 in a disassembled state.
Figure 6:
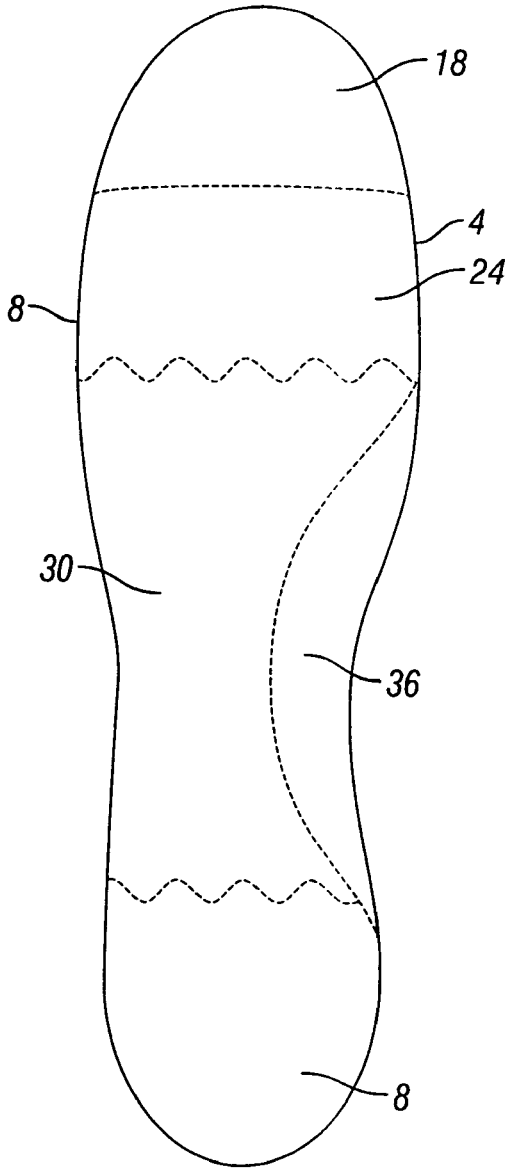
FIG. 6 is a bottom view of the bottom layer of FIG. 6A with the insole sections of FIGS. 5 and 5A in an assembled state like FIGS. 1, 4.

FIGS. 5, 5A, 6, and 6A show an insole for the right foot with FIG. 5 being the top surface and FIG. 6 being the bottom surface of the insole. FIG. 6 shows the bottom side 8 of the bottom layer 4 of the insole with the sections comprising a toe section 18, a metatarsal section 24, a base section 30, an arch section 36, and a heel section 8 shown in FIG. 5, attached to the bottom layer.

Figure 6A:
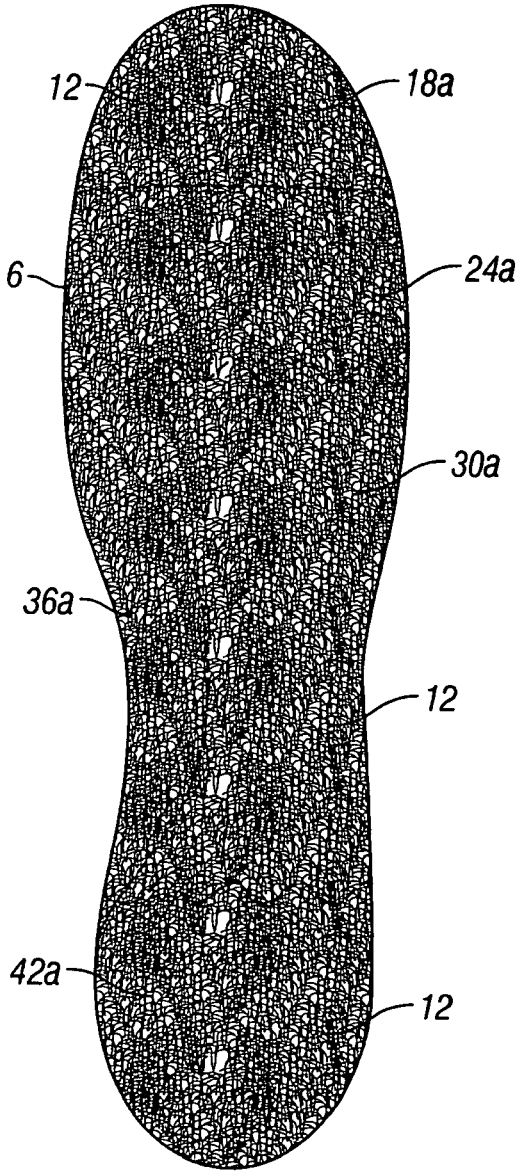
FIG. 6A is the top view of the bottom layer of FIG. 6 before the sections of FIGS. 5–5A are attached thereto.

While the embodiment in FIGS. 5A and 6A show a continuous section of attachment members along the undersides of the sections 18, 24, 30, 36, and 42, and along the top side of the bottom layer, the attachment members such as hook and loop fasteners need not extend to the edges of the insole sections or completely cover the bottom layer. Moreover, if there is a void between the different sections, it may be advantageous to avoid having hook 14 or loop 16 fasteners along the entire length of the bottom layer in order to prevent snagging of hosiery and socks, and to prevent discomfort for bare feet. The side views of the insole sections demonstrate that in an embodiment the sections have different elevations 70 from the other sections, and the sections can have different thickness 72 with respect to one another. See e.g. FIG. 3. For comfort, the sections preferably have the same or similar elevations where the sections interface one another. FIG. 4B shows the use of the insole in footwear that has a raised arch area 36*c*. While the sections may have differing elevations, it is desirable to have gradual changes in elevation so as to provide a surface that is continuous, or nearly continuous for a user's foot.

Of course, if desired, one or more of the insole sections of this invention may be combined with one another, but yet have different materials in the region of the toes, and/or metatarsal, and/or arch, and/or heel, and/or the remainder of the insole, herein referred to as a base 30.

A kit for providing a multiface and/or a multipiece insole for footwear is shown in FIGS. 7A–7G. The kit comprises a bottom layer having a top side, e.g. FIG. 7C, a plurality of sections having an underside, wherein the underside of one or more the sections is removably or securably attachable to the top side of the bottom layer, wherein the sections consist essentially of at least one longitudinal arch section 36, at least one heel section 42, at least one toe section 18, at least one metatarsal section 24, and a base section 30, attachment members for removably attaching the removably attachable sections to the top of the bottom layer, wherein the attachment members are located the top side of the bottom layer and on the underside of the removable sections, wherein an insole is formed by removably attaching the underside of one of each of the sections to the top side of the bottom layer. If desired one or more sections can also be integral with the bottom layer.

In an embodiment, at least one section is comprised of at least one material that is different from the material of the other sections.

Also in an embodiment, the attachment members comprise Velcro or Velcro-type hook components and loop components, wherein the hook components are attached to the top side of the bottom layer and the loop components are attached to the underside of the removable sections, or wherein the hook components are attached to the underside of the removable sections and the loop components are attached to the top side of the bottom layer. The hook and loop components form a holding assembly and hold the sections and bottom larger together when the hook and loop components are joined.

Further in an embodiment, at least some of the sections have a top layer.

The insole kit gives the user versatility in choosing sections and is especially useful in footwear for diabetics and others with pathologic or painful foot conditions.

The kit has insole sections that constructed of materials previously set forth herein and any other materials used by one skilled in the art for such purposes.

FIGS. 7A–7G show a kit that allows the user to choose the material types for each section, based upon comfort and needs. In this system, one or more of each of the removable sections are provided for each foot, which allows the user to choose and interchange sections depending upon what is most comfortable and/or desirable. For example, while engaging in exercise, a more or less rigid arch may be preferred over that worn in work shoes. Also, the arch, metatarsal, base, toe, and/or heel sections can be of varying shapes, materials and elevations to accommodate the feet of different users and for usage in different activities for the same user, as long as there is a smooth transition between the elevations of the sections, so that the edges of the sections do not protrude and do not cause discomfort during use. FIGS. 7A, 7B, 7E and 7F show an assortment of sections that can be used in this invention, in a disassembled state. The insole sections of this invention have attachment members 12 on at least a portion on their undersides as those shown on the inside areas of the heel, base and metatarsal sections FIG. 7G. The attachment members 12 can be placed on the entire underside of the sections see e.g. arch 36 and toe 12 sections. A strip of attachment members 12 such as hook and loop Velcro- type fasteners is placed on the underside of the metatarsal section 24 as in FIG. 7G, or in a cut-out type fashion, e.g. see heel section 42, and any other or configuration so long as the sections are adequately attached and do not become detached during use. FIGS. 7C–7D shows two embodiments the top side 6 of the bottom layer 4 of the insole with attachment members 12 thereon so that the insole the sections can be removably attached to the bottom layer. The insole sections of FIGS. 7A–7B, 7E–7G can be of varying elevations, like that shown in FIGS. 3A, 4A that show the side view of certain sections demonstrating that the sections have varying thickness. FIG. 7F shows the top side covering of a toe section 18 that is covered with moleskin 79, while the toe section 18 of FIG. 7G is covered in silk 80, while another is covered in satin 88, see FIG. 7A, and another is covered in fur, see FIG. 7E, and yet another in polyester 92, see FIG. 7B. Other materials with a low co-efficient of friction as well as other suitable materials known to one skilled in the art can also be used. Of course, other natural or synthetic materials, that are soft, cushioning, or rigid or semi-rigid, can also be used or the section may not have any covering over the material used to make the section.

FIGS. 7A–7B show metatarsal sections 24 made of leather 83 and of neoprene 84, respectively, and FIG. 7E and shows a base section 30 made of EVA foam 85. These materials choices shown in FIGS. 7A–7F are illustrative and other materials previously listed and/or known to one skilled in the art can also be used for the metatarsal sections of the insoles. Of course, other natural or synthetic materials, that are soft, cushioning, or rigid or semi-rigid, can also be used. While in some cases the section for one foot is different than that for the material choices for the other foot in the accompanying figures for the other foot, the figures are merely illustrative of the types of materials that can be used for the sections of either or both feet.

FIG. 7A shows a base section 30 of made of leather 83, FIG. 7B shows a base section 30 made of EVA foam 85, FIG. 7E shows a base section 30 made of neoprene 84, and FIG. 7F shows a base section comprised of plastic 86. Of course, other natural or synthetic materials, that are soft, cushioning, or rigid or semi-rigid, can also be used.

Heel section 42 of FIG. 7B is made of EVA foam 85 and has protrusions 44 and a slightly concave surface, FIG. 7E shows a heel section 42 made of rubber 90 that has protrusions 44 and a slightly concave surface, while heel section 42 of FIG. 7A lacks protrusions, and is made of neoprene 84.

Of course, the material types and surfaces of the sections for the kits as well as the bottom layer can be comprised of any material known to one skilled in the art as well as any of those previously set forth herein.

There can be more or fewer of each of the sections in the kit. These materials choices shown in FIGS. 7A–7F, as well as those previously discussed are illustrative and other materials known to one skilled in the art can also be used for the toe sections of the insoles. Further, in an embodiment, the kits contain sections made from like materials for each foot, but the insoles need not have sections for each foot that are comprised of the same materials.

It is also possible that some of the sections such as the toe piece, heel piece, and metatarsal piece may be used for the right foot and the left foot.

A method of making a multiface and/or multipiece insole for footwear is also contemplated, which comprises: providing a bottom layer having a top side, providing a plurality of sections having an underside, wherein the underside of one or more of the sections is attachable to the top side of the bottom layer, and removably or securably attaching the plurality of sections to the top side of the bottom layer to form an insole.

In this method, the sections are comprised essentially of a longitudinal arch section, a heel section, a toe section, a metatarsal section, a base section, or any combination thereof.

In an embodiment, at least one section is integral with the bottom layer, wherein the sections are comprised essentially of a longitudinal arch section, a heel section, a toe section, a metatarsal section, a base section, or any combination thereof.

The method can also further comprise the steps of: placing attachment members for removably attaching the removably attachable sections upon the top of the bottom layer and on the underside of the removable sections, and attaching the sections to the bottom layer. In an embodiment attachment members that comprise hook components and loop components, wherein the hook components are attached to the top side of the bottom layer and the loop components are attached to the underside of the removable sections, or wherein the hook components are attached to the underside of the removable sections and the loop components are attached to the top side of the bottom layer. When the hook and loop components are joined, they form a holding assembly and hold the sections and bottom layer together.

In this method, at least a portion of some of the sections is comprised of materials different from those in the other sections.

Also, this method can be used in footwear for diabetics and others with pathologic or painful foot conditions.

In an embodiment, a longitudinal arch section is removably attached to the bottom layer and/or a heel section is removably attached to the bottom layer and/or a toe section is removably attached to the bottom layer and/or a metatarsal section is removably attached to the bottom layer and/or a base section is removably attached to the bottom layer.

In this method, the sections fit together similar to puzzle pieces, and have shapes different from one another.

The insole is suitable for those with and without medical conditions and is especially beneficial in footwear for diabetics and others with pathologic or uncomfortable foot conditions.

The above description is that of preferred embodiments of the invention. It is intended that all matter contained in the above description and shown in the accompanying drawing is illustrative rather than limiting. It should further be understood that the following claims are intended to cover all of the generic and specific features of the invention herein described.

Various alterations and changes can be made without departing from the spirit and broader aspects of the invention as defined in the appended claims, which are to be interpreted in accordance with the principles of patent law including the doctrine of equivalents.

What is claimed is:

1. An insole for footwear, comprising:

a bottom insole layer having a top side;

a plurality of insole sections having an underside, wherein the underside of one or more of said insole sections is attachable to the top side of the bottom insole layer, wherein the plurality of insole sections is formed of different cushioning, hardness, thickness and/or surface characteristics from a variety of materials allowing secured and/or removable attachment to the insole and each of the plurality of insole sections include one or more layers of material to provide a substantially continuous top surface when all of said sections are attached to said bottom layer;

attachment members located on the top side of the bottom layer and on the underside of said sections for attaching the sections to the bottom layer; and wherein an insole is formed when the insole sections are attached to the top side of said bottom layer.

2. The insole of claim 1, wherein all of said insole sections are removably attached to said bottom layer, and wherein said sections are selected from the group consisting essentially of a longitudinal arch section, a heel section a toe section, a metatarsal section, a base section, or any combination thereof.

3. The insole of claim 2, wherein said attachment members comprise hook components and loop components, wherein the hook components are attached to the top side of the bottom layer and the loop components are attached to the underside of the sections, or wherein the hook components are attached to the underside of the sections and the loop components are attached to the top side of the bottom layer.

4. The insole of claim 3, wherein the hook and loop components form a holding assembly and hold sections and bottom layer together when said hook and loop components are joined together.

5. The insole of claim 1, wherein at least one of said sections is securably attached to said bottom layer, and wherein said sections are selected from the group consisting essentially of a longitudinal arch section, a heel section, a top section, a metatarsal section, a base section, or any combination thereof.

6. The insole of claim 5, having a metatarsal and/or base section made of materials selected from the group consisting essentially of leather, neoprene, EVA foam, or any combination thereof.

7. The insole of claim 5, having a toe section with a top layer selected from the group consisting essentially of moleskin, fur, polyester, satin, silk, or any combination thereof.

8. The insole of claim 5, having a heel section made of materials selected from the group consisting essentially of rubber, neoprene, EVA foam, or any combination thereof.

9. The insole of claim 1, wherein medial edges of said sections fit together similar to puzzle pieces.

10. The insole of claim 1, wherein said sections are selected from the group consisting essentially of a longitudinal arch section, a heel section, a toe section, a metatarsal section, a base section, any combination thereof and wherein each of said sections have at least one medial edge shaped to fit together with the shape of the medial edge of at least one other section in a puzzle-like manner.

11. The insole of claim 10, having sections with medial edges that are irregular in shape.

12. The insole of claim 10, having sections with medial edges that are a curved or straight line.

13. The insole of claim 1, wherein at least one of said sections has a top layer.

14. A shoe having an insole of claim 1.

15. A kit for providing a multipiece insole for footwear, comprising:

a bottom insole layer having a top side;

a plurality of insole sections having an underside, said plurality of insole sections consist essentially of at least one longitudinal arch section, at lease one heel section, at least one toe section, at least one metatarsal section, at least one base section, and wherein at least some of the sections are comprised of material different from the other sections, and further wherein the plurality of insole sections is formed of different cushioning, hardness, thickness and/or surface characteristics from a variety of materials for secure and/or removable attachment to the insole, and each of the plurality of insole sections include one or more layers of material to provide a substantially continuous top surface when all of said sections are attached to said bottom layer;

attachment members located on the top side of the bottom layer and on the underside of said section for attaching at least one of said plurality of sections to said bottom layer; and wherein an insole is formed by choosing one of each plurality of insole sections, and attaching the underside of one of each said sections to the top side of said bottom layer.

16. The kit of claim 15, wherein at least one section is comprised of a material that is different from at least one other section.

17. The kit of claim 15, wherein said insole sections are removably attacked in said bottom layer and wherein said attachment members comprise hook components and loop components, wherein the hook components, wherein the hook components are attached to the underside of the removable sections, or wherein the hook components are attached to the underside of the removable sections and the loop components are attached to the top side of the bottom layer.

18. The kit of claim 17, wherein the hook and loop components form a holding assembly and hold the sections and bottom layer together when said hook and loop components are joined.

19. The kit of claim 15, wherein at least some of the plurality of said sections have a top layer.

20. The kit of claim 15, wherein an assembled insole is comprised of a bottom layer a longitudinal arch section, a heel section, a toe section, a metatarsal section, a base section, and wherein the underside of said sections are securably attached to the top side of said bottom layer.

* * * * *